United States Patent [19]

Brown

[11] Patent Number: 4,555,856

[45] **Date of Patent: * Dec. 3, 1985**

[54] BOW SIGHT

[76] Inventor: Dewey E. Brown, Rte. 4, Box 126, Bastrop, La. 71220

[ * ] Notice: The portion of the term of this patent subsequent to Apr. 2, 2002 has been disclaimed.

[21] Appl. No.: 621,954

[22] Filed: Jun. 18, 1984

Related U.S. Application Data

[63] Continuation-in-part of Ser. No. 512,355, Jul. 11, 1983, Pat. No. 4,507,874.

[51] Int. Cl.[4] ..... F41G 1/46

[52] U.S. Cl. ..... 33/265; 124/87

[58] Field of Search ..... 33/265, 233; 356/17, 356/21; 124/22, 87

[56] References Cited

U.S. PATENT DOCUMENTS 4,167,333 9/1979 Young et al. ..... 33/265

4,178,693 12/1979 Smith ..... 33/265

*Primary Examiner*—William D. Martin, Jr.

*Attorney, Agent, or Firm*—John M. Harrison

[57] ABSTRACT

A bow sight for use with compound bows, recurve bows and long bows which includes a housing enclosing a bottom mirror, a top mirror mounted in spaced relationship in the housing with respect to the bottom mirror and a narrow compensating mirror positioned in the housing in close proximity to the bottom mirror. The top and bottom mirrors are mounted in substantially parallel relationship at approximately a 45° angle in the housing and the top mirror and compensating mirror are pivotally mounted, with the compensating mirror adjustably responsive to manipulation of a lever from a calibrated position. The target image segment projected from the top mirror to the bottom mirror is compared to the target image segment projected from the compensating mirror to the bottom mirror and the lever is moved rearwardly, if necessary in order to provide the necessary adjustment to align the segments and determine a proper trajectory for accurately delivering an arrow to the target.

20 Claims, 5 Drawing Figures

FIG. 1
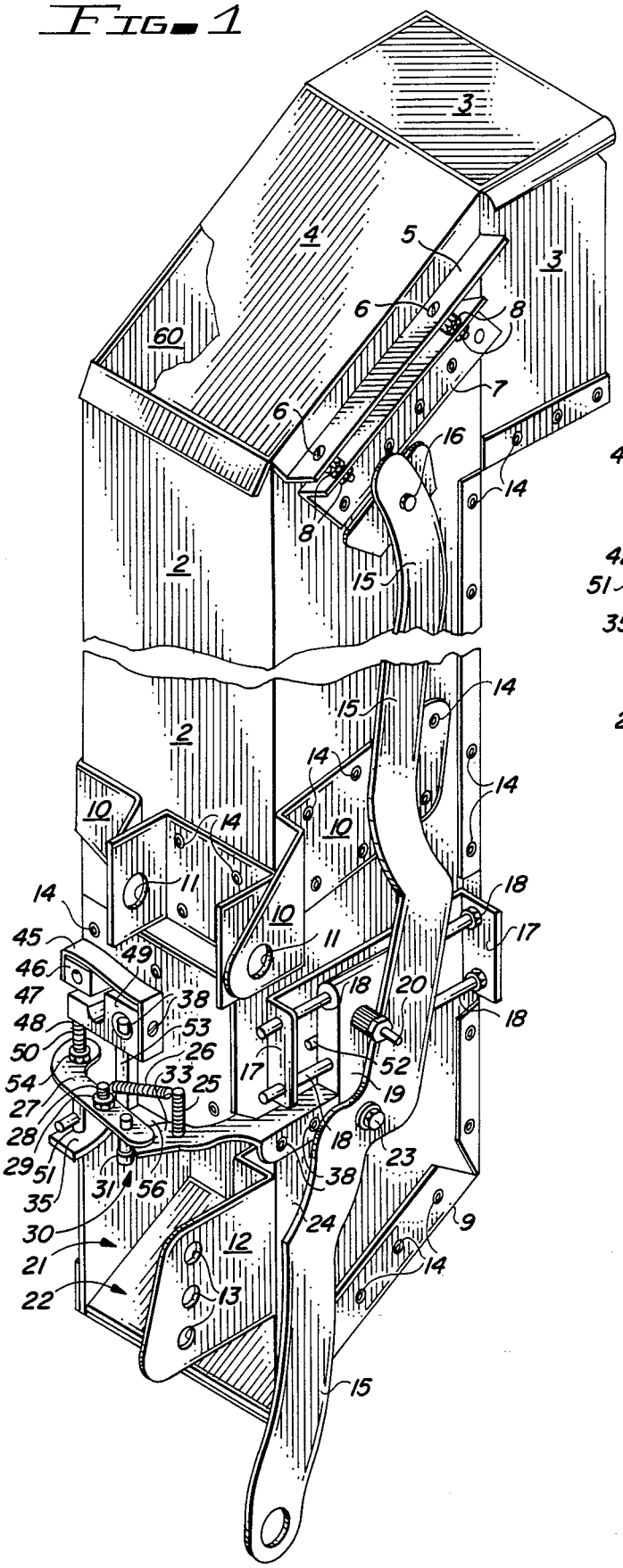
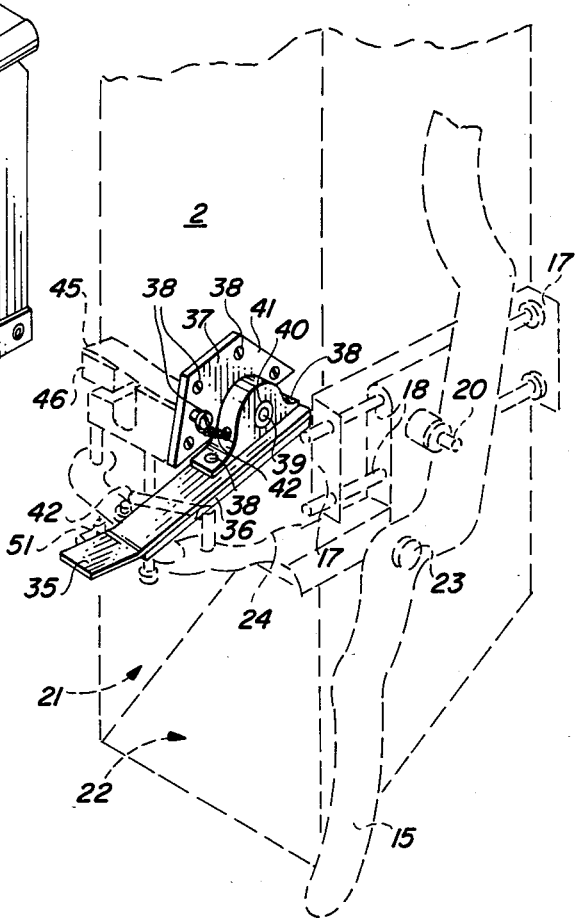
FIG. 2
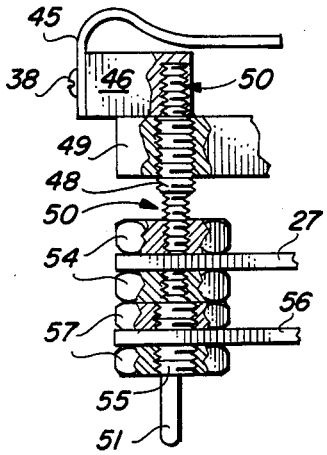
FIG. 5

BOW SIGHT

CROSS-REFERENCE TO RELATED APPLICATIONS

This application is a Continuation-In-Part of my copending Patent Application Ser. No. 512,355, filed July 11, 1983, now U.S. Pat. No. 4,507,874.

BACKGROUND OF THE INVENTION

1. Field of the Invention

It is well known that archery is an extremely difficult sport, in that the delivery of an arrow accurately to a target depends upon several variables. These variables include the length and position of the draw, the steadiness with which the bow is held in the hand and the release of the arrow from the same anchor point with each shot. In addition, the elevation of the arrow must be adjusted to compensate for the distance over which it is to travel and adjustments must frequently be made for windage. The delivery of an arrow accurately in order to kill game efficiently is particularly difficult because of these variables. This difficulty is increased because of the human error in accurately judging distance, a shortcoming which sometimes results in the arrow either falling short of, or flying over the target. Such errors in judging distances can be minimized by the use of sight pins and sighting devices of various design, which aid the archer in determining the distance to the target.

2. Description of the Prior Art

Various devices are known in the art for increasing the accuracy of an arrow delivered to a target. Typical of such devices is the "Archer's Bow" disclosed in U.S. Pat. No. 2,001,470, dated May 14, 1935, to Y. J. Nyvall, which device discloses a folding bow having a pair of top and bottom mirrors serving to reflect the target, the image of which is reflected by the top mirror to the eye of an archer. The lower mirror is reticulated in such relation to the longitudinal center of an arrow seated on arrow support ledges in the bow, that when the target appears in the lower mirror at the intersection of cross-hairs in the reticule, the arrow can be accurately directed toward the target. The patent makes it clear, however, that an aiming allowance must be made for trajectory and for air currents. U.S. Pat. No. 3,163,697, dated Dec. 29, 1964, to D. S. White, discloses an "Archery Bow Sight Utilizing Optical Range Finder and Coupled Sighting Element". The patent is drawn to a dual, spaced mirror device arranged such that the viewer will simultaneously see both a real and a reflected target image. As the viewer looks at the target, a slide is manipulated until real and reflected images are both seen at the same height. When this position is reached, the bow is aimed at the target and is properly positioned such that an arrow shot from the bow will assume the proper trajectory for the distance to the target. U.S. Pat. No. 3,524,440, dated Aug. 18, 1970, to Walter D. Hill, discloses an "Archery Bow Including Mirror Sighting Device" which includes an upper and lower mirror aligned in substantially vertical relationship with respect to each other forwardly of the bow, with cross-hairs or other target-aligning means mounted on one of the mirrors. The lower mirror is focused on the target, while the upper mirror is focused on the lower mirror and reflects the target image to the archers eye. The mirror mounting the cross-hairs may be adjusted vertically to compensate for distance, and horizontally, to compensate for windage. U.S. Pat. No. 3,861,051, dated Jan. 25, 1975, to Gerald I. Killian, discloses an "Arrow Draw Check for Archery Bows" which includes a mirror mounted for movement with an archery bow sight and arranged to reflect to the eye of the archer, the image of a tip of a drawn arrow in registry with an index mark on the mirror. A "Range Finding Device for Archery Bows" is disclosed in U.S. Pat. No. 2,788,701, dated Apr. 16, 1957, to G. G. Browning, which device incorporates multiple mirrors mounted below a single upper mirror for reflecting the image of the target and transmitting this image to the eye at various levels to facilitate trajectory adjustment of the bow for accurate delivery of an arrow to a target.

In my copending Application Ser. No. 512,355, filed July 11, 1983, I describe a bow sight which is characterized by a periscope device enclosing a top mirror and a bottom mirror mounted in generally 45° angular relationship in order to transmit an image from the top to the bottom mirror. A compensating mirror is also mounted in the housing in generally parallel, but adjustable relationship with respect to the top and bottom mirrors and an opening in the housing allows the target image received by the compensating mirror to be reflected onto the bottom mirror, along with the image in the top mirror, such that a split target image is viewed in the fixed bottom mirror. Comparison of this split target image facilitates raising the bow to a proper angle in order to compensate for the drop of the arrow from the bow to the target.

It is an object of this invention to provide a bow sight for long bows, recurve bows and compound bows, which sight assists the archer in adjusting the bow trajectory for distance without the necessity of determining the distance between the viewer and the target.

It is a further object of this invention to provide a bow sight which is applicable to bows of varying contour, design and construction and which uses an adjustable compensating mirror in cooperation with an adjusting mechanism, a top mirror and a fixed bottom mirror to compensate for the drop of an arrow over a wide range of distances.

Another object of this invention is to provide a new and improved sighting device for long bows, recurve bows and compound bows, which sighting device is characterized by a housing carrying three enclosed mirrors in parallel relationship, one of which mirrors is adjustably mounted at the top of the housing, another fixedly mounted at the bottom of the housing and the third and more narrow compensating mirror pivotally located between the top and bottom mirrors and aligned with an opening in the housing, for adjustment by means of a lever to align the segments of a split target image projected in the bottom mirror from the top mirror and the compensating mirror, when a range compensation in elevation must be made relative to a straight line between the viewer and the target.

A still further object of the invention is to provide a new and improved bow sight for recurve bows, long bows and compound bows which includes a periscope device having an image-receiving compensating mirror adjustably mounted between parallel top and bottom mirrors, which compensating mirror is pivoted responsive to manipulation of a lever from a calibrated position to align corresponding image segments reflected in the bottom mirror by the compensating mirror and the top mirror and thereby determine the degree of elevation necessary to compensate for the drop of the arrow over the distance between the viewer and the target.

SUMMARY OF THE INVENTION

These and other objects of the invention are provided in a bow sight which is suitable for mounting on a long bow, a recurve bow or a compound bow, which bow sight includes a periscope device enclosing a top and bottom mirror mounted in generally parallel, 45° angular relationship with respect to each other in order to transmit a target image segment from the top mirror to the bottom mirror, and a compensating mirror pivotally mounted in the housing in close proximity to, and more narrow than the bottom mirror and independently receiving the target image along with the top mirror and reflecting the remainder of the target image segment on the bottom mirror, which compensating mirror is adjustable by means of a lever and linkage mechanism to align the target image reflected in the bottom mirror and superimpose a sight pin image in the bottom mirror on the target image, for accurate delivery of an arrow to the target.

BRIEF DESCRIPTION OF THE DRAWING

The invention will be better understood by reference to the accompanying drawings, wherein:

FIG. 1 is a perspective view of a preferred embodiment of the bow sight;

FIG. 2 is a perspective view of a preferred compensating mirror mounting for the bow sight illustrated in FIG. 1;

FIG. 5 is a sectional view of a portion of a preferred compensating mirror linkage for use in the bow sight.

DESCRIPTION OF THE PREFERRED EMBODIMENTS

Figure 3:
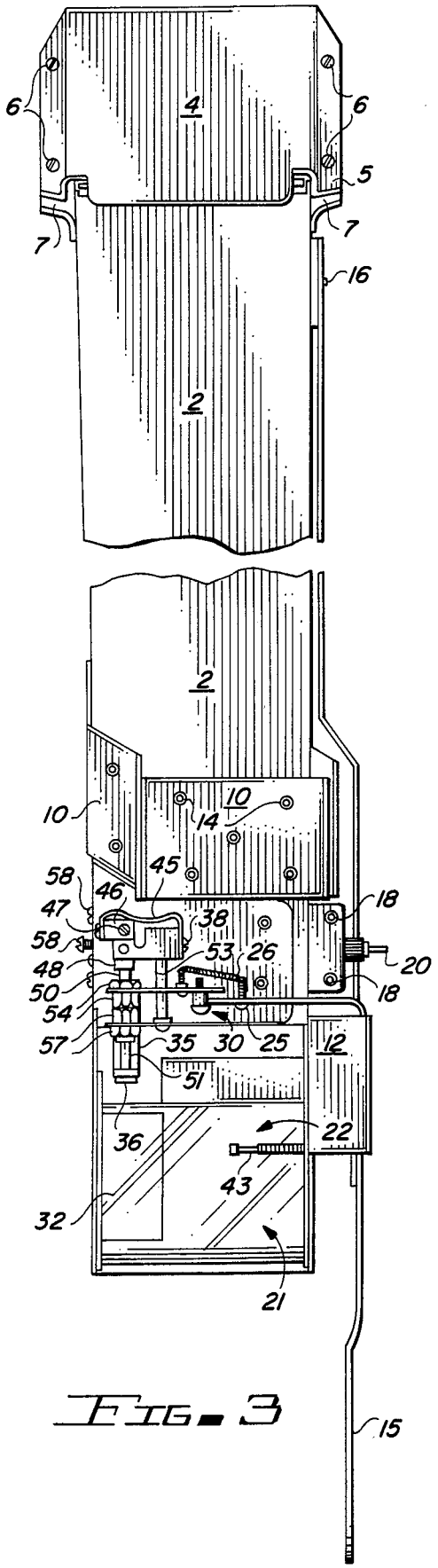
FIG. 3 is a rear elevation of the bow sight as viewed by an archer.
Figure 4:
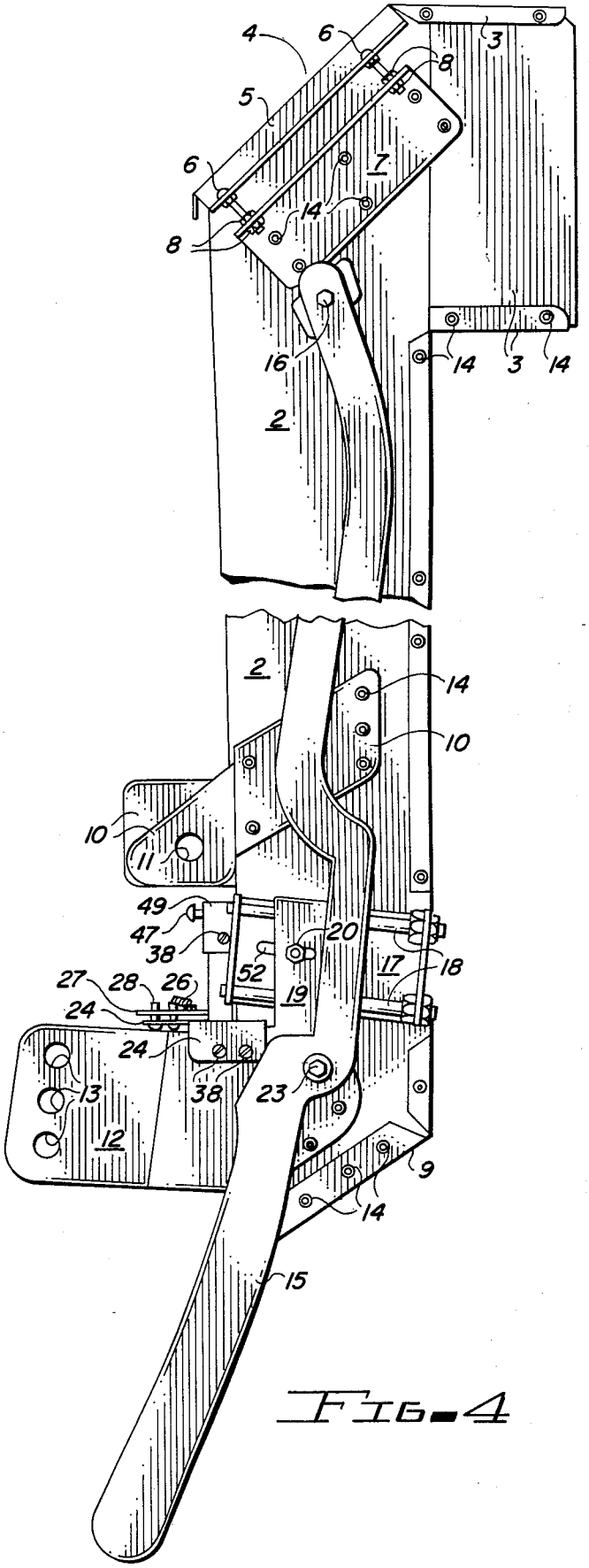
FIG. 4 is a right side elevation of the bow sight.

Referring to FIGS. 1, 3 and 4 of the drawings in a preferred embodiment, the bow sight of this invention is generally illustrated by reference numeral 1 and includes an elongated housing 2, having a hood 3 projecting from one end thereof. The housing 2 is provided with a removable top mirror plate 4, which includes a pair of plate flanges 5, with the top mirror plate 4 adjustably mounted to the housing 2 by means of plate bolts 6 and adjusting nuts 8, in cooperation with plate bolt flanges 7, secured to each side of the housing 2. A mount bracket 10 extends rearwardly from the housing 2 for removable attachment to the bow riser of a bow (not illustrated). As illustrated in FIG. 1, the mount bracket 10 is provided with mount bracket apertures 11, through which a mounting bolt (not illustrated) can be projected, in order to cooperate with the bow riser of the bow and removably secure the bow sight 1 to the bow. A sight pin bracket 12 extends rearwardly from the housing 2 beneath the mount bracket 10 and is provided with sight pin apertures 13, which are located to receive optional sight pins (not illustrated), as desired. It will be appreciated that three sight pins can be provided in the sight pin bracket apertures 13 to define various trajectories at different distances from a target in conventional fashion, as deemed necessary by the archer. In a preferred embodiment of the invention the housing 2 is constructed of aluminum and the mount bracket 10 and sight pin bracket 12, as well as the plate bolt flanges 7, are secured to the housing 2 by means of rivets 14.

Referring now to FIGS. 1–4, a top mirror 60 is secured to the inside of the top mirror plate 4 and is disposed in angular relationship inside the housing 2 and opposite the hood 3, in order to face outwardly of a top opening defined and framed by the hood 3. Similarly, a bottom mirror 22 is disposed in angular relationship on the interior surface of the bottom plate 9 of the housing 2, and is oriented opposite a viewing opening 21. The top mirror 60 and the bottom mirror 22 are disposed inside the housing 2 at an angle of about 45 degrees in generally parallel and aligned relationship, such that the housing 2 acts as a periscope, wherein the images of objects focused in the top mirror 60 are reflected to the bottom mirror 22 and to an observer viewing the bottom mirror 22 through the viewing opening 21. In a most preferred embodiment of the invention, and referring to FIG. 2, a narrow compensating mirror 36 is provided between and in generally parallel orientation with respect to the top mirror 60 and the bottom mirror 22 and is secured to a compensating mirror bracket 35. A bearing bracket 41, housing a bearing 39, is secured to the compensating mirror bracket 35 by means of mount bolts 38. A bearing bolt 40, extending through the bearing 39, and threaded in a compensating mirror bracket mount 37, serves to pivotally join the bearing bracket 41 and the compensating mirror bracket 35 to the compensating mirror bracket mount 37. The compensating mirror bracket mount 37 is secured to the housing 2 by means of additional mount bolts 38, which extend through the housing 2 and are threaded into the compensating mirror bracket mount 37. An adjusting screw 58 is threaded in the housing 2 and rests against the compensating mirror bracket mount 37, for lateral adjustment of the compensating mirror bracket mount 37. A mirror tension spring 42 extends from the bearing bracket 41 to the compensating mirror bracket 37, in order to bias the extending end of the compensating mirror bracket 35 upwardly.

Accordingly, it will be appreciated from a consideration of FIG. 2 of the drawings that the compensating mirror bracket 35 and the compensating mirror 36 are free to rotate in concert on the bearing bolt 40, as hereinafter described. Referring again to FIGS. 1–5, the bow sight 1 is provided with a lever 15, which is pivoted to one side of the housing 2 near the hood 3 by means of a lever pin 16 and extends along one side of the housing 2. A slide bracket 17 is secured to the same side of the housing 2 as the lever 15 and is fitted with a pair of spaced rails 18, extending the entire length of the slide bracket 17 and spanning the width of the housing 2. A lever slide 19 is mounted on the rails 18 in sliding relationship and a sight pin 20 extends through the lever slide 19, through a slot 52 in the slide bracket 17 and then through a corresponding slot in the housing 2 (not illustrated), to project inside the housing 2. The sight pin 20 is reflected in the bottom mirror 22 and is clearly visible as a sight pin image 43 to a viewer looking into the viewing opening 21, when the bow sight 1 is oriented as illustrated in FIG. 3. The lever 15 is attached with a selected degree of tolerance to the lever slide 19 by means of a bolt 23, which registers with an oversized opening (not illustrated) in the lever 15 to facilitate easy adjustment of the lever 15 and the lever slide 19 as the lever 15 is manipulated from front to rear and is pivoted on the lever pin 16. A programmed slide 24 is situated with one end attached by means of mount bolts 38 to the lever slide 19 and the opposite end extending above the viewing opening 21, as illustrated in FIG. 1. The extending end of the programmed slide 24 is shaped to define a curved slide edge 33 and a programmed slide bolt 25 is threaded through the programmed slide 24 and receives one end of a coil spring 26. As illustrated in FIGS. 1 and 5, the rod end 51 of a threaded rod 50 engages the compensating mirror bracket 35 and the opposite end of the threaded rod 50 terminates in a spring block 46, which is attached by means of a leaf spring 45 and cooperating mount bolts 38, to a sleeve block 49. The sleeve block 49 is in turn secured to the housing 2 by means of a mount bolt 38. The threaded end of the threaded rod 50 is secured in non-rotatable fashion inside the spring block 46 by means of a set screw 47 and the bias in the leaf spring 45 forces the threaded rod 50 downwardly through an upper threaded sleeve 48 and a lower threaded sleeve 55, such that the rod end 51 exerts pressure against the compensating mirror bracket 35. The upper threaded sleeve 48 is threadibly secured in the sleeve block 49 and the lower threaded sleeve 55 is secured in a sleeve bracket 56 by means of a pair of sleeve bracket nuts 57. The sleeve bracket 56 is rigidly spaced from the sleeve block 49 by means of a brace 53. A pair of arm nuts 54 are threaded on the threaded rod 50 at a point above the sleeve bracket 56 and serve to secure one end of an arm 27 to the threaded rod 50. The arm 27 extends toward the slide edge 33 of the programmed slide 24 and a shoulder bolt 30, is threaded into the extending end of the arm 27. The shank 31 of the shoulder bolt 30 is positioned in engagement with the slide edge 33 of the programmed slide 24 and is biased in this position by means of the coil spring 26. One end of the coil spring 26 is attached to the programmed slide bolt 25, as heretofore described, while the opposite end of the coil spring 26 is secured to an arm bolt 28, which is secured to the arm 27 by means of nut 29.

In operation, and referring again to the drawings and to FIGS. 1, 3 and 5 in particular, the bow sight 1 is first mounted to the riser of a bow by means of the mount bracket 10, as heretofore described. The bow sight 1 is then calibrated by pushing the lever 15 forward to the full travel of the lever slide 19 on the rails 18. The bow sight 1 is now in calibrated mode and is ready for use. When a target is sighted, the bow sight 1 is oriented as illustrated in FIG. 3 at arms length and the bottom mirror 22 is viewed. The sight pin image 43 is then seen in the top half of the bottom mirror 22 and the target image will be split, with a portion of the target image viewed in the top mirror reflection 44 in the bottom mirror 22 and the rest of the target image viewed in the compensating mirror reflection 32 in the bottom mirror 22. The bow sight 1 is calibrated such that when the lever 15 is in the forward position as described above, that portion of the target image which is seen in the compensating mirror reflection 32 will be in alignment with or located above that portion of the target image which is viewed in the top mirror reflection 44, when the target is within the calibrated range of the bow. Under these circumstances, the sight pin image 43 in the bottom mirror 22 can be aligned with the target image by manipulating the bow, without further adjustment of the lever 15 and an arrow can be accurately delivered to the target. However, if that portion of the target image appearing in the compensating mirror reflection 32 is below that segment of the target image seen in the top mirror reflection 44, then the target is out of range for accurate arrow delivery by aligning the sight pin image 43 directly with the target. If an arrow were delivered from the bow under these conditions without further adjustment of the bow sight 1, the arrow would fall short of the target. Accordingly, the bow sight 1 is adjusted to compensate for the target distance by manipulating the lever 15 gradually rearwardly while viewing the target, until that portion of the target image in the compensating mirror reflection 32 is aligned with that portion of the target image in the top mirror reflection 44. The bow sight 1 is then properly calibrated for the distance between the bow and the target and the sight pin image 43 can be aligned with the target image by manipulating the bow, in full assurance that an arrow will be accurately delivered to the target. This distance calibration is achieved since the sight pin image 43 moves downwardly in the bottom mirror 22 in proportion to the elevation required for the bow in order to compensate for drop of the arrow over the distance to the target. The distance calibration has been carefully determined over a wide range of distances up to the maximum range of the bow and has proved to be extremely accurate.

Referring again to FIGS. 1–5, as described above, a calibrated adjustment of the compensating mirror reflection 32 observed in the bottom mirror 22 is achieved by movement of the lever 15 rearwardly, which causes the lever slide 19 to move on the rails 18. As the lever slide 19 traverses the rails 18, the programmed slide 24 is caused to move outwardly of the housing 2, and the shank 31 of the shoulder bolt 30 is caused to traverse the slide edge 33 of the programmed slide 24. Due to the design configuration of the slide edge 33, this action effects a controlled rotation of the arm 27 in the clockwise direction as viewed from the top. Rotation of the arm 27 effects rotation of the arm nuts 54 on the threads of the threaded rod 50, which action forces the threaded rod 50 downwardly, and the unthreaded rod end 51 against the compensating mirror bracket 35, to rotate the compensating mirror bracket 35, the bearing bracket 41 and the compensating mirror 36 against the bias of the mirror tension spring 42. This graduated downward movement of the threaded rod 50 is aided by the bias of the leaf spring 45, which exerts pressure on the spring block 46 and results in application of an axial force on the threaded rod 50. This axial force applied against the compensating mirror bracket 35 is balanced by the bias applied to the compensating mirror bracket 35 by the mirror tension spring 42. Since the threaded rod 50 is biased axially against the compensating mirror bracket 35 and the threaded rod 50 is slidably retained in the upper threaded sleeve 48 and the lower threaded sleeve 55 and the bottom one of the fixedly mounted arm nuts 54 is touching the top one of the sleeve bracket nuts 57, the threaded rod 50 must move against the compensating mirror bracket 35 in proportion to the degree of rotation of the arm nuts 54 thereon, as the lever 15 is manipulated rearwardly.

It will be appreciated from a consideration of FIG. 3 of the drawings that the split target image reflected by the top mirror 60 and the compensating mirror 36 on the bottom mirror 22 is made possible because of the difference in width between the top mirror 60 and the compensating mirror 36. In a preferred embodiment of the invention the compensating mirror 36 is from about one-fourth to about one-half of the width of the top mirror 60, resulting in a relatively narrow compensating mirror reflection 32, in comparison with the top mirror reflection 44.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A bow sight comprising:
(a) a housing;
(b) a first opening provided in one end of said housing and a top mirror adjustably positioned in angular relationship in said one end of said housing and facing said first opening;
(c) a second opening provided in the opposite end of said housing and facing in the opposite direction from said first opening and a bottom mirror positioned in said opposite end of said housing, said bottom mirror facing said second opening and disposed in generally parallel relationship with respect to said top mirror;
(d) a third opening provided in said housing between said first opening and said second opening, said third opening facing in the same direction as said first opening and a compensating mirror adjustably positioned in said housing and facing said third opening; and
(e) adjusting means in cooperation with said housing and said compensating mirror, whereby a first segment of a target image received by said top mirror is reflected to said bottom mirror and a corresponding segment of the target image received by said compensating mirror is simultaneously and independently reflected to said bottom mirror for comparison of the first segment and the corresponding segment of the target image and calibration of an arrow trajectory by manipulation of said adjusting means.

2. The bow sight of claim 1 wherein said compensating mirror is closer to said bottom mirror than to said top mirror.

3. The bow sight of claim 1 further comprising a mount bracket carried by said housing for mounting said bow sight to a bow.

4. The bow sight of claim 1 further comprising sight pin means extending through said housing, said sight pin means positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror.

5. The bow sight of claim 1 wherein said compensating mirror is closer to said bottom mirror than to said top mirror and further comprising:
(a) a mount bracket carried by said housing for mounting said bow sight to a bow; and
(b) sight pin means extending through said housing, and positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror.

6. The bow sight of claim 1 further comprising hood means cooperating with said housing and extending around the periphery of said first opening.

7. The bow sight of claim 1 wherein said adjusting means further comprises a lever having one end pivotally attached to said housing; slide means having a movable element carried by said lever and a fixed element in cooperation with said housing; pin means having one end biased in cooperation with said compensating mirror and an arm threadibly carried by said pin means, said arm positioned in slidable, biased contact with said slide means, whereby manipulation of said lever causes said slide means to traverse and rotate said arm and force said pin means against said compensating mirror to adjust said compensating mirror.

8. The bow sight of claim 1 wherein said adjusting means further comprises a lever having one end pivotally attached to said housing; slide means having a movable element carried by said lever and a fixed element in cooperation with said housing; pin means having one end biased in cooperation with said compensating mirror and an arm threadibly carried by said pin means, said arm positioned in slidable, biased contact with said slide means, whereby manipulation of said lever causes said slide means to traverse and rotate said arm and force said pin means against said compensating mirror to adjust said compensating mirror, and further comprising:
(a) a mount bracket carried by said housing for mounting said bow sight to a bow;
(b) sight pin means extending through said housing, said sight pin means positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror; and
(c) hood means cooperating with said housing and extending around the periphery of said first opening.

9. A bow sight comprising:
(a) a generally elongated housing;
(b) a first opening provided in one end of said housing, said first opening facing substantially transverse to the longitudinal axis of said housing and a first mirror adjustably mounted in angular relationship in said housing and facing said first opening;
(c) a second opening provided in the opposite end of said housing, said second opening facing substantially transverse to the longitudinal axis of said housing and disposed 180 degrees from said first opening, and a second mirror mounted in said opposite end of said housing in substantially parallel relationship with respect to said first mirror and facing said second opening;
(d) a third opening provided in said housing between said first opening and said second opening, said third opening disposed substantially 180 degrees from said second opening and disposed beneath said first opening and a compensating mirror facing said third opening and having a width which is less than the width of said first mirror and said second mirror, said compensating mirror adjustably mounted in said housing in substantially parallel relationship with respect to said first mirror and said second mirror; and (e) adjusting means in cooperation with said compensating mirror and carried by said housing for moving said compensating mirror toward said second mirror and causing a first segment of the target image in said compensating mirror to align with a second segment of the target image in said top mirror when said first segment of the target image and said second segment of the target image are reflected in said bottom mirror, as said top mirror and said compensating mirror are focused on a target.

10. The bow sight of claim 9 wherein said compensating mirror is closer to said second mirror than to said first mirror.

11. The bow sight of claim 9 further comprising a mount bracket carried by said housing for mounting said bow sight to a bow.

12. The bow sight of claim 9 wherein said compensating mirror is closer to said second mirror than to said first mirror and further comprising a mount bracket carried by said housing for mounting said bow sight to a bow.

13. The bow sight of claim 9 further comprising sight pin means extending through said housing, said sight pin means positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror.

14. The bow sight of claim 9 wherein said compensating mirror is closer to said second mirror than to said first mirror and further comprising:

(a) a mount bracket carried by said housing for mounting said bow sight to a bow; and (b) sight pin means extending through said housing, said sight pin means positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror.

15. The bow sight of claim 14 further comprising hood means cooperating with said housing and extending around the periphery of said first opening.

16. A bow sight for a bow comprising:

(a) a generally elongated housing;

(b) a first opening provided in one end of said housing, said first opening facing substantially transverse to the longitudinal axis of said housing and a first mirror adjustably mounted in angular relationship in said housing and facing said first opening;

(c) a second opening provided in the opposite end of said housing, said second opening facing substantially transverse to the longitudinal axis of said housing and disposed 180 degrees from said first opening, and a second mirror mounted in said opposite end of said housing in substantially parallel relationship with respect to said first mirror and facing said second opening;

(d) a third opening provided in said housing between said first opening and said second opening, said third opening disposed substantially 180 degrees from said second opening and disposed beneath said first opening and a compensating mirror facing said third opening and having a width which is less than the width of said first mirror and said second mirror, said compensating mirror adjustably mounted in said housing in substantially parallel relationship with respect to said first mirror and said second mirror; and (e) a lever having one end pivotally attached to said housing; slide means having a lever slide carried by said lever and a pair of rails carried by said housing, said lever slide slidably carried by said rails; first bias means carried by said housing and a threaded pin having one end in contact with said compensating mirror and the outer end of said threaded pin fixedly secured to said bias means, whereby said threaded pin is biased against said compensating mirror; arm means threadibly carried by said threaded pin, said arm means positioned in contact with said lever slide and second bias means in cooperation with said arm means and said lever slide, whereby manipulation of said lever causes said lever slide to traverse said rails and rotate said arm and exert additional pressure on said threaded pin to adjust said compensating mirror.

17. The bow sight of claim 16 further comprising sight pin means extending through said housing, said sight pin means positioned to facilitate a sight pin reflection of said sight pin means in said bottom mirror, said sight pin reflection visible to a viewer, whereby said bow sight is calibrated by manipulation of said adjusting means and an arrow trajectory is determined by aligning said sight pin reflection with the target image in said bottom mirror.

18. The bow sight of claim 17 further comprising a mount bracket carried by said housing for mounting said bow sight to a bow.

19. The bow sight of claim 18 wherein said compensating mirror is closer to said bottom mirror than to said top mirror.

20. The bow sight claim 19 further comprising hood means cooperating with said housing and extending around the periphery of said first opening.

* * * * *